US009574778B2

(12) United States Patent
Woods et al.

(10) Patent No.: US 9,574,778 B2
(45) Date of Patent: Feb. 21, 2017

(54) OVEN WITH DOOR HAVING A CONVEX SHAPED SURFACE

(76) Inventors: Derek Glenn Woods, Charlotte, NC (US); Nicholaus Basil Cunningham-Benjamin, Charlotte, NC (US)

( * ) Notice: Subject to any disclaimer, the term of this patent is extended or adjusted under 35 U.S.C. 154(b) by 588 days.

(21) Appl. No.: 13/422,283

(22) Filed: Mar. 16, 2012

(65) Prior Publication Data

US 2013/0239944 A1 Sep. 19, 2013

(51) Int. Cl.
*F23M 7/00* (2006.01)
*F24C 15/02* (2006.01)

(52) U.S. Cl.
CPC ..... *F24C 15/026* (2013.01)

(58) Field of Classification Search
CPC ..... F24C 15/026
USPC ..... 126/190; 235/381
See application file for complete search history.

(56) References Cited

U.S. PATENT DOCUMENTS 1,578,826 A * 3/1926 Hobson ..... F24C 15/02 126/190
1,800,519 A * 4/1931 Fredberg ..... F25D 23/021 126/190
2,104,994 A * 1/1938 Hughes ..... F24C 15/02 126/190
3,429,629 A * 2/1969 Cilia ..... B42F 15/0005 206/309
3,692,012 A * 9/1972 Wiggins ..... A47J 37/07 126/25 A
3,809,058 A * 5/1974 Becker ..... F24B 1/181 126/500
3,856,073 A * 12/1974 Risser ..... E05D 15/165 160/201
4,726,352 A * 2/1988 Radke ..... F24C 15/026 126/190
5,375,587 A * 12/1994 Ward ..... F24C 15/026 126/190
6,199,548 B1 * 3/2001 Hsu ..... F24C 15/023 126/190
6,686,574 B2 * 2/2004 Hyun ..... H05B 6/6414 126/190
7,252,082 B2 * 8/2007 Bartmann ..... F24C 15/026 126/191

(Continued)

FOREIGN PATENT DOCUMENTS

DE 19651225 A1 * 6/1998 ..... F24C 15/02

OTHER PUBLICATIONS

Machine Translation of Martin et al.; Accessed by Examiner on Jul. 24, 2014 via Espacent http://translationportal.epo.org/emtp/translate?ACTION=description-retrieval&COUNTRY=DE&ENGINE=google&FORMAT=docdb&KIND=C2&LOCALE=en_EP&NUMBER=19651225&OPS=ops.epo.org/3.1&SRCLANG=de&TRGLANG=en&PDF=true.*

*Primary Examiner* — Avinash Savani
*Assistant Examiner* — George R Blum
(74) *Attorney, Agent, or Firm* — Metz Lewis Brodman Must O'Keefe LLC

(57) ABSTRACT

An oven is provided that includes an internal surface that faces a cooking area of the oven. An oven door is present that has a convex surface. The oven door is movable from a closed position in which the oven door blocks access to the cooking area from outside of the oven to an open position in which the oven door does not block access to the cooking area from outside of the oven. The oven may also include a receiving compartment that receives at least a portion of the oven door when the oven door is in the open position.

20 Claims, 12 Drawing Sheets

(56) References Cited

U.S. PATENT DOCUMENTS 7,255,101 B2 * 8/2007 Grutzke ..... E05D 15/36 126/190
7,549,572 B1 * 6/2009 Branan ..... A47G 29/1209 232/45
8,047,198 B2 * 11/2011 Meyer ..... F24C 15/023 126/190
8,905,014 B2 * 12/2014 Shaffer ..... F24C 15/023 126/190
8,936,017 B2 * 1/2015 Holdo Baggott ..... A23L 1/0128 126/190
2003/0121973 A1 * 7/2003 Lee ..... G07F 19/20 235/381
2003/0146203 A1 * 8/2003 Wang ..... F24C 15/02 219/411
2005/0023945 A1 * 2/2005 Bartmann ..... F24C 15/026 312/319.2
2005/0134158 A1 * 6/2005 Bartmann ..... F24C 15/026 312/319.2
2006/0225580 A1 * 10/2006 Fernandez ..... A47J 37/041 99/419
2006/0289530 A1 12/2006 Cordae
2007/0267402 A1 11/2007 Harned et al.
2012/0060699 A1 * 3/2012 Shidler ..... A47J 37/0704 99/341
2012/0288596 A1 * 11/2012 Holdo Baggott ..... A23L 1/0128 426/235
2013/0174831 A1 * 7/2013 Shaffer ..... F24C 15/023 126/190
2013/0239944 A1 * 9/2013 Woods ..... F24C 15/026 126/190
2013/0255656 A1 * 10/2013 Schootstra ..... F24C 15/026 126/190
2016/0245532 A1 * 8/2016 Eliasson ..... A21B 1/44

* cited by examiner

OVEN WITH DOOR HAVING A CONVEX SHAPED SURFACE

FIELD OF THE INVENTION

The present invention relates generally to an oven that has door with a convex shaped surface that increases the amount of space available to cooks and others in a kitchen. More particularly, the present application involves an oven door that has an outer surface that is convex in shape that can be rotated by a user from a closed position down into an open position in a compartment below a cooking area of the oven so that space in front of the oven is not taken up by the presence of an oven door.

BACKGROUND

Oven doors found in residential and commercial settings are typically hinged at the bottom and provided with a handle at the top so that the cook grasps the handle and pulls the oven door forward and downward into the open position. The oven door thus rotates about the bottom, hinged position and in the open position extends almost completely forward. The user of the oven must stand a long distance away from the cooking area of the oven in order to place food into and remove food from the cooking area. Further, if the interior surface of the oven door is hot, this hot surface presents a safety risk to the user and other people and animals in the vicinity of the oven. Another concern with oven doors lies in the layout of a typical kitchen. Some kitchens, for example those in apartments or those that are small, have limited space and an open oven door may interfere with the opening of doors of cabinets and appliances in the kitchen. Handicapped people, such as those in wheelchairs, may not be able to maneuver their assistance device in front of the oven and open the oven door because the presence of the person or assistance device would interfere with the opening oven door due to its outward movement.

One known oven door design that attempted to correct problems associated with oven doors involved the use of a pivoting and sliding connection. Here, the oven door was moved from the closed position to the open position by first pivoting the oven door about its bottom in the conventional manner. Once moved into the open position, the oven door was then slid in a linear direction into the oven. This arrangement removed most of the oven door from view and allowed the cook to stand closer to the cooking area when checking on food located in the oven or when putting food into or removing food out of the oven. Although capable of hiding an oven door when open, such design would still be difficult for people having an assistance device such as a cane or wheel chair to open due to the outward movement of the oven door during opening. Further, such an oven door design may strike or otherwise interfere with other open doors on appliances or cabinets in the kitchen.

Another oven door design features an automatic opening oven door. The oven door is made of a series of sections that ride along a track. The cook may press a button and a motor will actuate to move the sections of the oven door along the track so that they are moved into the body of the oven. Although capable of opening and closing an oven door, this design is expensive and requires a significant number of mechanical and electrical parts and is thus not a robust design. Further, since the oven door is made of a number of sections it exhibits areas of heat loss due to gaps between the sections. This heat loss may become worse over time and can increase the cost of operating the oven, reduce the effectiveness food is cooked, and undesirably heat up the kitchen. As such, there remains room for variation and improvement within the art.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended Figs. in which.

Figure 1:
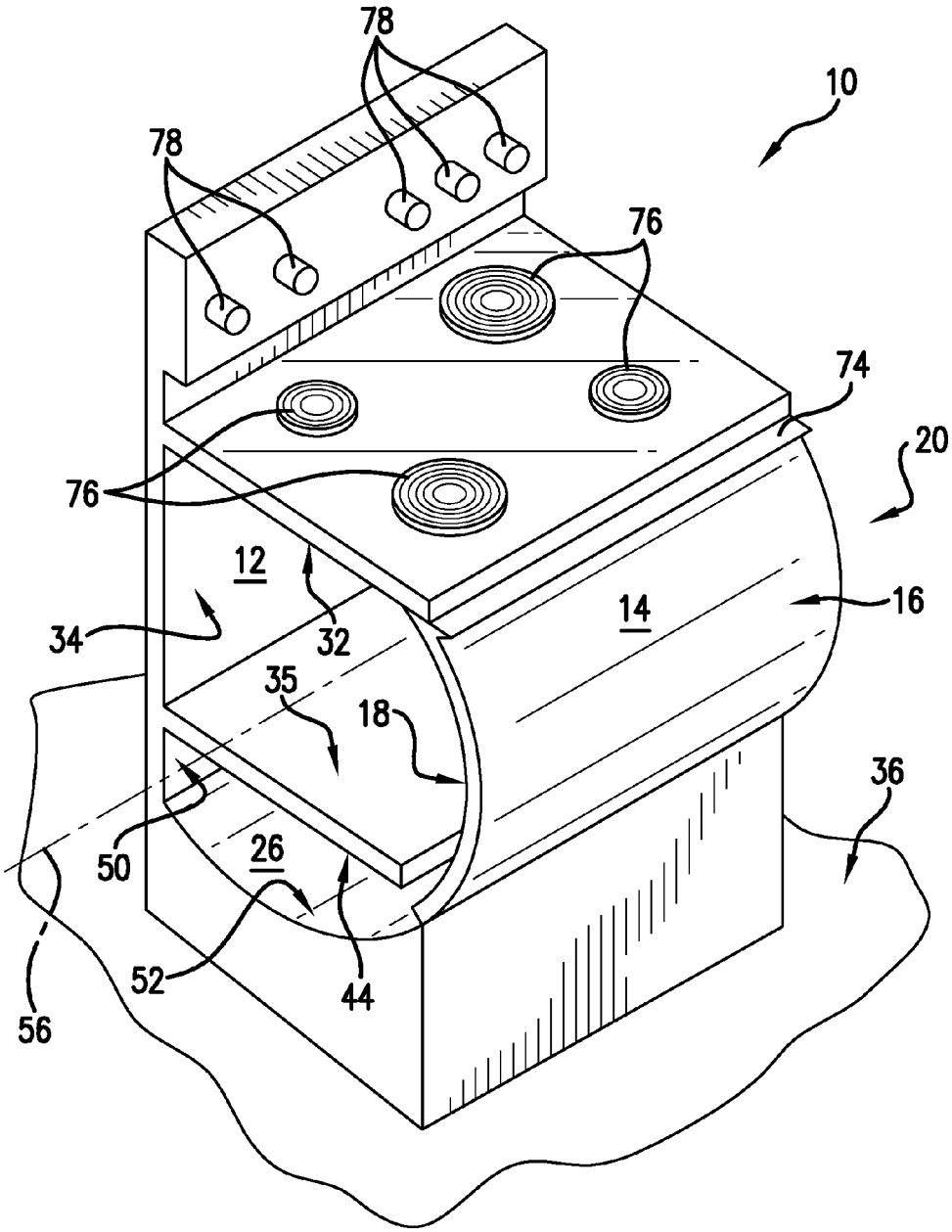
FIG. 1 is a perspective view of an oven with an oven door in a closed position in accordance with one exemplary embodiment.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

The present invention provides for an oven 10 that has an oven door 14 that has at least one surface, such as an outer surface 16, which has a convex shape. The oven door 14 can be moved from a closed position 20 to an open position 24 by the user upon grasping a handle 74 of the oven door 14 and sliding the oven door 14 downwards. The oven door 14 may move along a travel path 54 that is curved from the closed position 20 to the open position 24. The oven 10 may include a receiving compartment 26 into which the oven door 14 is at least partially disposed when the oven door 14 is moved into the open position 24. The travel path 54 may be completely curved along its entire length. The oven door 14 can be moved from the closed position 20 to the open position 24 so that it does not extend at all, or only minimally extends, in the longitudinal depth direction 40 during the opening process. The oven door 14 may remain out of the way of users of the oven 10 allowing the users to move close to the cooking area 12 of the oven 10 and to avoid being burned by a hot oven door 14. Doors from cabinets and other appliances in the kitchen may be opened and closed without interference from the oven door 14 when the oven door 14 is in the open position 24 since it may be received within the receiving compartment 26.

Figure 2:
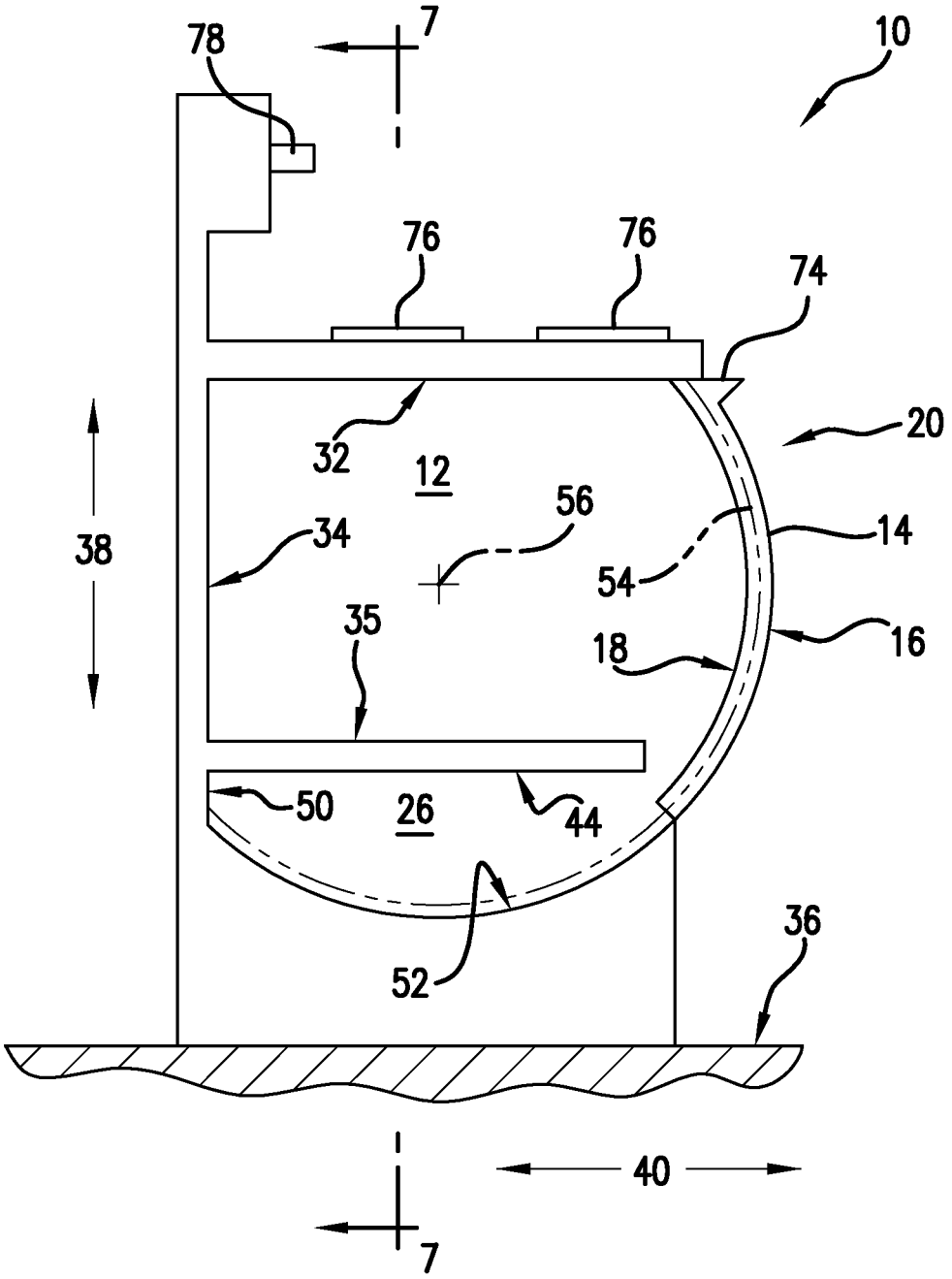
FIG. 2 is a side view of the oven of FIG. 1.
Figure 3:
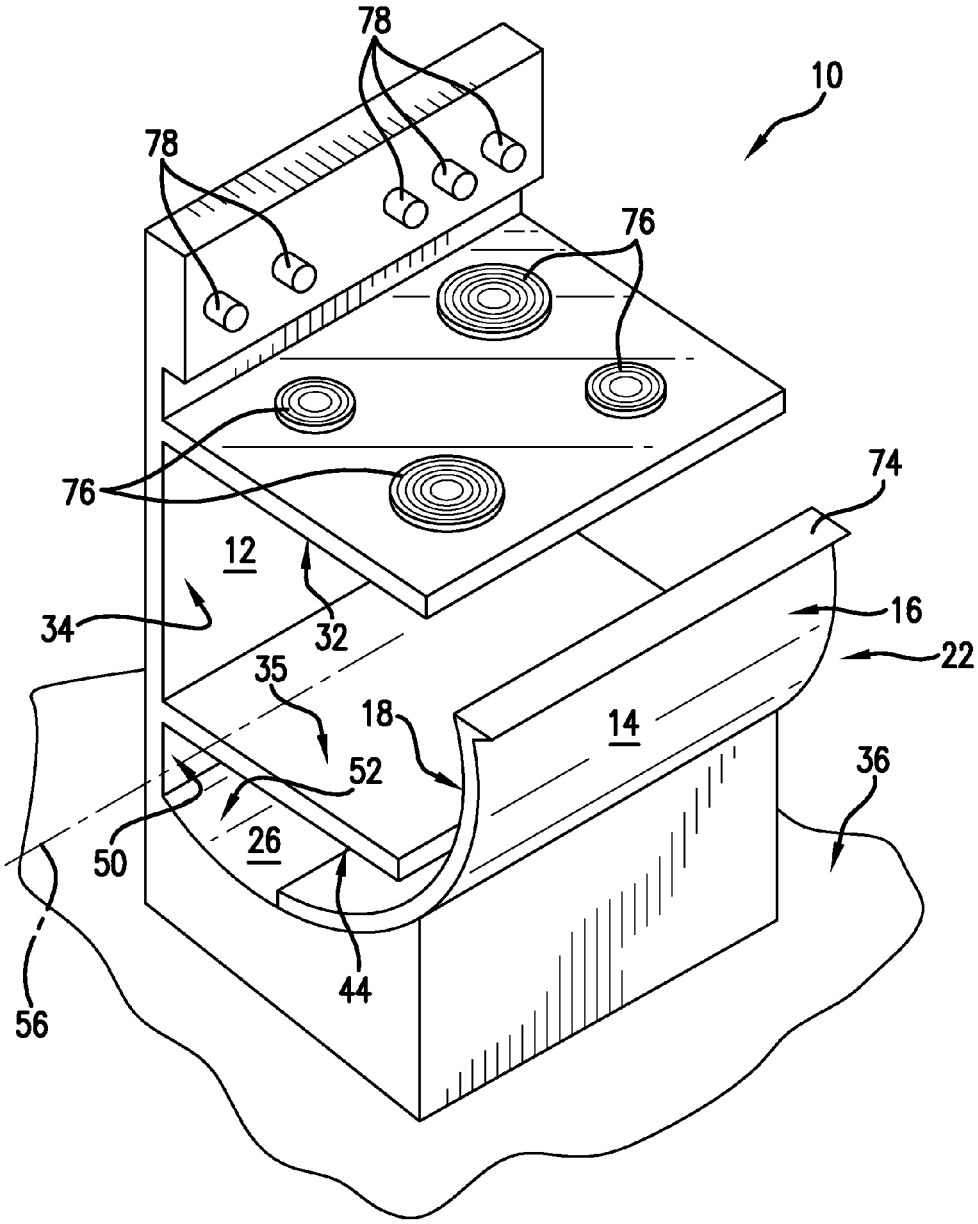
FIG. 3 is a perspective view of the oven of FIG. 1 with the oven door in an intermediate position.
Figure 4:
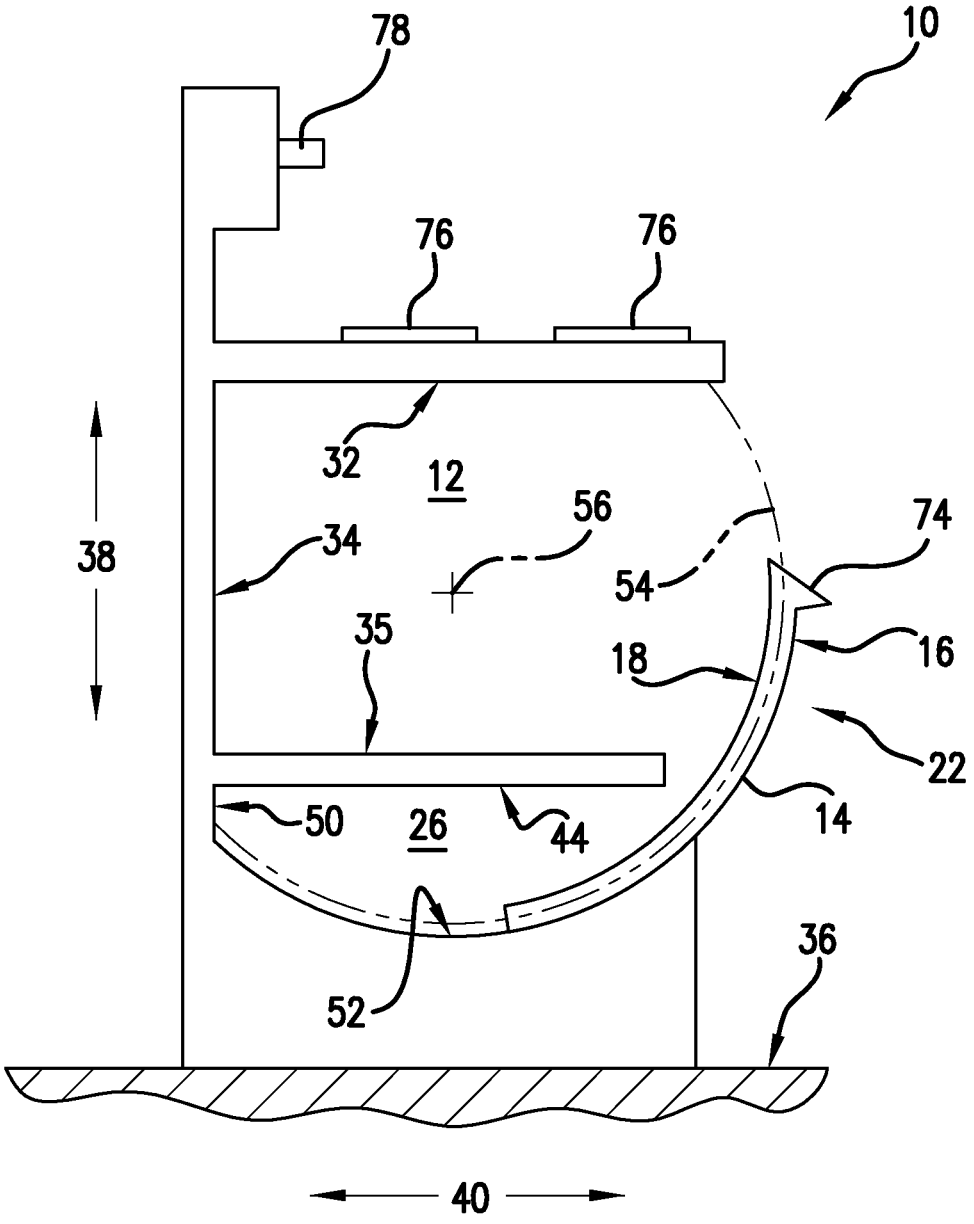
FIG. 4 is a side view of the oven of FIG. 3.
Figure 5:
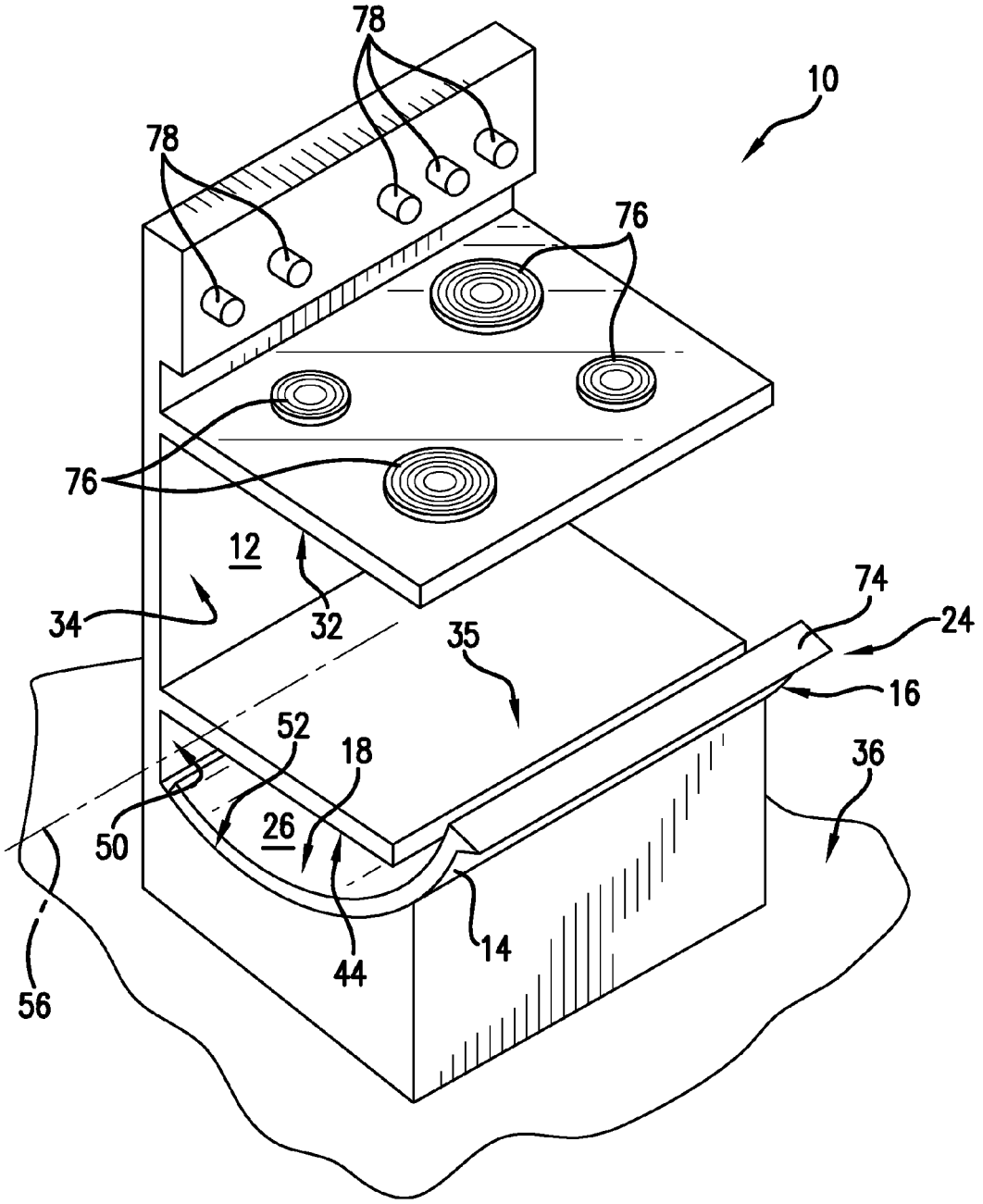
FIG. 5 is a perspective view of the oven of FIG. 1 with the oven door in an open position.
Figure 6:
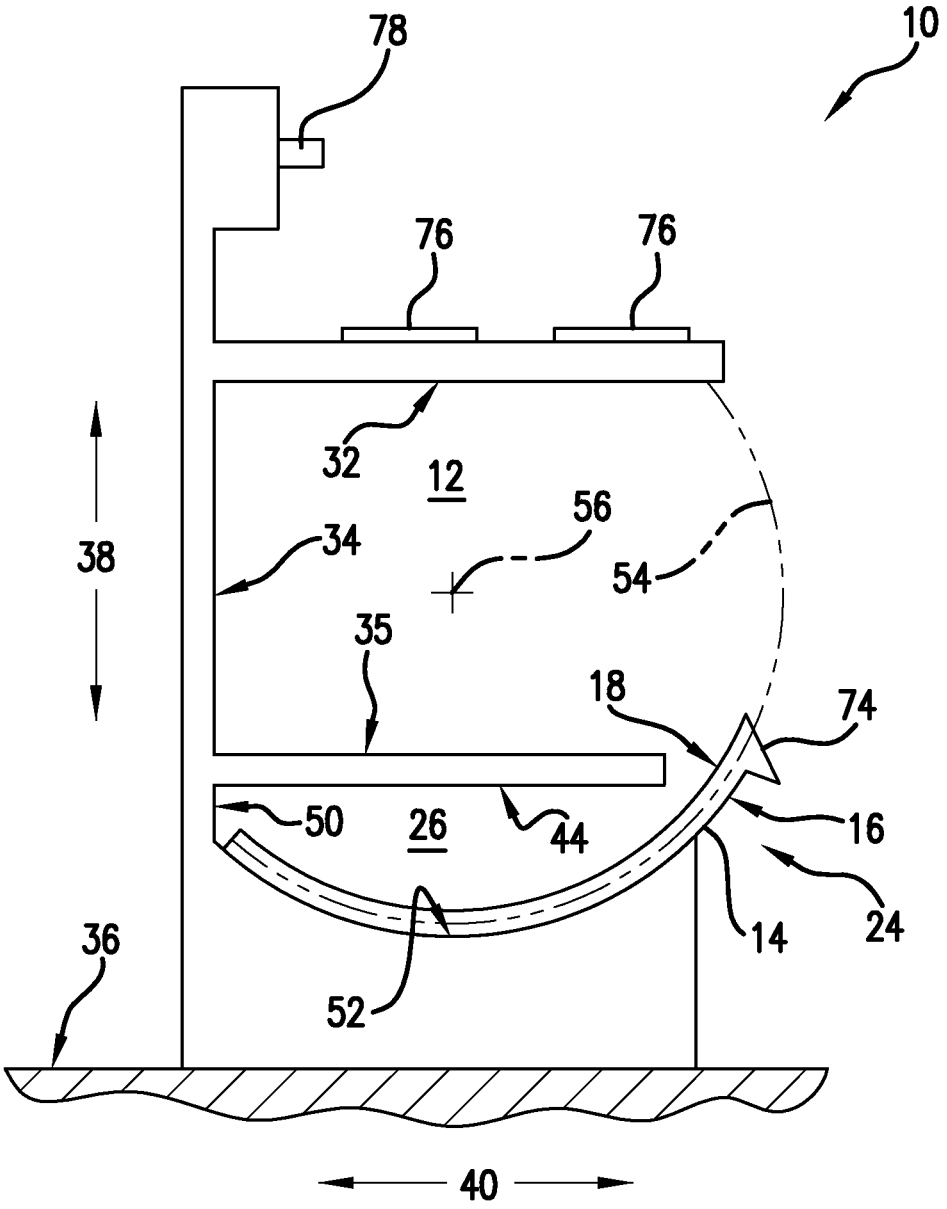
FIG. 6 is a side view of the oven of FIG. 5.

With reference now to the drawings, FIGS. 1 and 2 disclose an oven 10 with the oven door 14 in the closed position 20. The oven 10 in FIGS. 1 and 2 is a range oven. These types of ovens are stoves that have the ability to cook various things at a single time. For example, food can be placed within a cooking area 12 of the oven 10 and heated at a desired temperature for a desired amount of time. Burners 76 are located on an upper, horizontal surface of the oven 10 and food or water in pots and pans can be placed on the different burners 76 and heated for a desired time and amount. Control knobs 78 can be located on a vertical surface of the oven 10 and may be used to control the heat intensity of the different burners 76 and cooking area 12. The oven can be gas or electric powered and is generally considered to be an appliance in a kitchen. In this regard, the home owner can move the oven 10 onto a floor 36 of the home and the oven 10 may remain on the floor 36 and contact the floor 36 for the entire working life of the oven 10 while the oven 10 cooks food. The oven 10 can have various additional features such as one or more timers, a self cleaning feature, a broil feature, or cooking area 12 lights in accordance with various exemplary embodiments.

When the oven door 14 is located in the closed position 20, the cooking area 12 of the oven 10 is sealed such that it is defined by closed surfaces on all sides except for the oven door side that is closed by the closed oven door 14. In FIGS. 1 and 2, and also in FIGS. 3-6, the side panels 58 and 62 of the oven 10 are not shown for purposes of clarity. The upper end of the oven door 14 engages a lower surface of a horizontal wall of the oven 10 that is located in an upper portion of the oven 10. The upper end of the oven door 14 can be provided with a handle 74 that can be grasped by the user and pushed or pulled to allow the oven door 14 to be moved. The handle 74 may have apertures that receive fingers of the user and additionally or alternatively may have a ridge or other finger receiving surface to aid in grasping. The oven door 14 may thus be manually moved by the user without the need to use any motors or other automatically powered movement mechanisms.

The oven door 14 may move along a travel path 54 that is curved. The travel path 54 is the path of travel of the oven door 14 relative to other parts of the oven 10 such as the cooking area 12 or cooking area back surface 34 which may be part of a frame of the oven 10 that is a compartment that does not move relative to the floor 36 during use of the oven 10. The travel path 54 may be the length and path of travel of the oven door 14 from the closed position 20 to the open position 24, with a reverse of this from the open position 24 back to the closed position 20 being the same length and path. The travel path 54 may have a single radius along its entire length such that all points of the travel path 54 are located the same distance from an axis of revolution 56 of the travel path 54. The travel path 54 can be curved along its entire length from the highest point of the oven door 14 in the vertical direction 38 in the closed position 20 to the most rearward, deepest point of the oven door 14 in the longitudinal depth direction 40 when in the open position 24. In other embodiments, the travel path 54 may have one or more linear sections in addition to one or more curved sections. Although described has having a single radius distance from the axis of revolution 56 to the travel path 54 along the entire length of the travel path 54, this need not be so in accordance with other exemplary embodiments. For example, the travel path 54 may be curved along its entire length but may have certain portions that are closer to the axis of revolution 56 than other portions. As such, instead of having an arc length that resembles a circle, the travel path 54 may have an arc length that resembles an oval, parabola, or other curved member.

The axis of revolution 56 of the travel path 54 may be located within the cooking area 12, although it may be located in other portions of the oven 10 or even outside of the oven 10 in accordance with other exemplary embodiments. The travel path 54 may have a single axis of revolution 56, or may have multiple axis of revolution 56 in accordance with various exemplary embodiments. The travel path 54 may extend any amount around the axis of revolution 56 in accordance with various exemplary embodiments. The travel path 54 may extend less than 360° around the axis of revolution 56 in various exemplary embodiments. The travel path 54 may extend less than 270°, less than 200°, less than 180° or less than 90° about the axis of revolution 56 in accordance with various exemplary embodiments of the oven 10. In other arrangements, the travel path 54 may extend from 45° to 90°, from 90° to 180°, from 180° to 220°, from 220° to 270°, or up to 360° about the axis of revolution.

The oven door 14 has an inner surface 18 that faces towards the cooking area 12 when the oven door 14 is in the closed position 20, and the oven door has an outer surface 16 that faces in a direction opposite to the inner surface 18. The inner surface 18 directly faces the cooking area 12 and the heating elements of the oven 10. The outer surface 16 faces away from the cooking area 12 in the longitudinal depth direction 40 when the oven door 14 is in the closed position 20. The outer surface 16 has a convex shape such that it curves forward and then rearward in the longitudinal depth direction 40 upon extension from top to bottom in the vertical direction 38 when the oven door 14 is in the closed position 20. The outer surface 16 may have a shape complimentary to the shape of the travel path 54. The outer surface 16 may have an axis of revolution that is coaxial with or parallel to the axis of revolution 56 of the travel path 54. The axis of revolution of the outer surface 16 may thus extend in the lateral width direction 42 of the oven 10. The curvature of the outer surface 16 can extend in the vertical direction 38 and not in the lateral width direction 42 when the oven door 14 is in the closed position 20. Although described as being convex in shape, the outer surface 16 may be variously shaped in accordance with other exemplary embodiments.

The inner surface 18 of the oven door 14 can be concave in shape. The inner surface 18 may be provided so that its axis of revolution is coaxial with or parallel to the axis of revolution 56 of the travel path 54. The concave shape of the inner surface 18 may be such that it extends forward and then backward in the longitudinal depth direction 40 upon extension from the top to bottom in the vertical direction 38. The concave shape of the inner surface 18 may be complimentary to the shape of the travel path 54, and in some arrangements the concave shape of the inner surface 18 may have the same degree of curvature and a coaxial axis of revolution with the outer surface 16. Although described as being concave in shape, the inner surface 18 may be variously shaped in accordance with other exemplary embodiments.

The oven 10 includes a receiving compartment 26 that is located below the cooking area 12 in the vertical direction 38. The receiving compartment 26 may be a separate compartment from the cooking area 12 such that these two areas are completely separate from one another. In other arrangements, a space may extend between the cooking area 12 and the receiving compartment 26, and in yet other exemplary embodiments the receiving compartment and the cooking area 12 may be regarded as being a single space. As such, the receiving compartment 26 need not be a completely separate compartment from the cooking area 12 but may be either completely separate, partially separate, or essentially one in the same as the cooking area 12. Also, the receiving compartment 26 may be located vertically above the cooking area 12 in other exemplary embodiments in the vertical direction 38. In yet other arrangements, the receiving compartment 26 may be located to the side of the cooking area 12 such that the receiving compartment 26 is located on either the right hand side or the left hand side of the cooking area 12 in the lateral width direction 42 of the oven 10.

The receiving compartment 26 has a receiving compartment bottom surface 52 that has a concave shape. The curved shape of the receiving compartment bottom surface 52 may be complimentary to the curved shape of the outer surface 16 and to the curved shape of the travel path 54. The receiving compartment bottom surface 52 may have an axis of revolution that is coaxial with or parallel to the axis of revolution 56. The receiving compartment bottom surface 52 is curved in the longitudinal depth direction 40 such that it falls down and then rises up in the vertical direction 38 upon extension from the forward to the rearward direction in the longitudinal depth direction 40. The axis of revolution of the receiving compartment bottom surface 52 may extend in the lateral width direction 42. The receiving compartment bottom surface 52 may be completely concave or only partially concave in various arrangements of the oven 10. Although described as being concave in shape, the receiving compartment bottom surface 52 need not be concave in shape in other exemplary embodiments. The receiving compartment bottom surface 52 may be completely flat, partially flat, completely convex, or partially convex in accordance with other embodiments. The receiving compartment bottom surface 52 may be made up of a single piece or may be multiple pieces attached to one another. Further, there may be apertures through the receiving compartment bottom surface 52 in other arrangements. In yet other exemplary embodiments, the receiving compartment bottom surface 52 is made of a number of rollers or is made of several smaller separate sections. As such, the form and make up of the receiving compartment bottom surface 52 may be greatly varied in different arrangements of the oven 10.

In the closed position 20, the oven door 14 is not received within the receiving compartment 26 and no portion of the oven door 14 is located within the receiving compartment 26. Although a gap is shown in the longitudinal depth direction 40 between the receiving compartment top surface 44 and the oven door 14, this gap could be closed or otherwise sealed in other exemplary embodiments so that the cooking area 12 is not in communication with the receiving compartment 26. This type of arrangement may prevent heat loss from the cooking area 12 in some instances.

When the user wants to open the oven door 14, the user may grasp the handle 74 and push or pull the oven door 14 downwards in the vertical direction 38. This movement will cause the oven door 14 to be moved into an intermediate position 22 as illustrated with Reference to FIGS. 3 and 4. Movement of the oven door 14 will be along the travel path 54. The travel path 54 is curved, and the oven door 14 will not extend beyond this path of travel in the longitudinal depth direction 40. As such, the maximum extension of the oven door 14 in the longitudinal depth direction 40 towards the user will be the same as when the oven door 14 is in the closed position 20, intermediate position 22, and potentially open position 24. However, it may be seen that the handle 74 at the top of the oven door 14 will in fact extend outwards in the longitudinal depth direction 40 so that it does in fact extend farther when in the intermediate position 22 than in the closed position 20 or open position 24. However, the remaining portions of the oven door 14 will not be located any farther towards a user of the oven 10 in the longitudinal depth direction 40 when located in any of the positions 20, 22 and 24.

The oven door 14 can extend in the longitudinal depth direction 40 towards the user a maximum amount when in the closed position 20 such that movement towards the open position 24 and into the open position 24 does not cause any portion of the oven door 14, except possibly the handle 74 in some embodiments, to move any closer to the user of the oven 10 in the longitudinal depth direction 40. In some arrangements, the oven door 14 can be made so that it will not cause itself and all other portions of the oven door 14 to move towards the user in the longitudinal depth direction 40 upon opening or movement from the closed position 20 into other positions of the oven door 14. With such an arrangement, the opening of the oven door 14 may afford the user more room in the kitchen to open drawers, cabinets, and doors of other appliances since the oven door 14 is not moving in the longitudinal depth direction 40 upon opening or closing, and has a generally low profile with the front of the oven 10.

Movement of the oven door 14 from the closed position 20 to the intermediate position 22 causes a lower portion of the oven door 14 to be received within the receiving compartment 26. The convex outer surface 16 may engage the complimentary concave receiving compartment bottom surface 52 such that these two components easily receive and essentially slide over one another. Continued movement of the oven door 14 downwards in the vertical direction 38 by the user will cause the oven door 14 to move from the intermediate position 22 into the open position 24 illustrated with reference to FIGS. 5 and 6. In the open position 24, the oven door 14 extends its maximum length into the receiving compartment 26. A portion of an in some embodiments the majority or all of the curved surface 16 and/or 18 of the oven door 14 can be located within the receiving compartment 26. The oven door 14 may engage a receiving compartment back surface 50 or may not engage but remain in close proximity thereto when in the open position 24. A majority of the length of the outer surface 16 may engage the complimentary receiving compartment bottom surface 52. The oven door 14 has traveled its maximum distance along the travel path 54 from the closed position illustrated in FIGS. 1 and 2. As shown, the handle 74 along with a portion of the length of the outer and inner surfaces 16 and 18 are not located within the receiving compartment 26 but actually function to block a portion of the cooking area 12 from a user situated right in front of the oven 10 in the longitudinal depth direction 40. However, it is to be understood that in other arrangements that the oven 10 can be configured so that the oven door 14 extends either completely into the receiving compartment 26 or to such an extent within the receiving compartment 26 that the handle 74 and other portions of the oven door 14 are not in front of the cooking area 12 and thus are at or below a cooking area bottom surface 35 in the vertical direction 38.

In order to reposition the oven door 14 back into the closed position 20, the user need only grasp the handle 74 and pull the oven door 14 upwards in the vertical direction 38 to reverse its travel path and place the oven door 14 back into the closed position 20. Again, the oven door 14 will not extend any closer towards the user in the longitudinal depth direction 40 due to the curved shape of the oven door 14 and the arrangement of the receiving compartment 26. The oven door 14 will be closest to the user when in the closed and intermediate positions 20 and 22 than when in the open position 24. The handle 74 may in fact extend towards the user in the longitudinal depth direction 40 such that it is closer to the user when in the intermediate position 22 than when in the closed position 20. However, this approach towards the user may only be negligible due to the relatively small size of the handle 74. Again, the handle 74 could be made so as to be low profile in shape and size thus causing no portion of the oven door 14 to be any closer to the user in the longitudinal depth direction 40 when opening the oven door 14 such that its closest approach would be in both the closed and intermediate positions 20 and 22 and this closest approach in the longitudinal depth direction 40 would be the same when in both the closed position 20 and the intermediate position 22.

Figure 7:
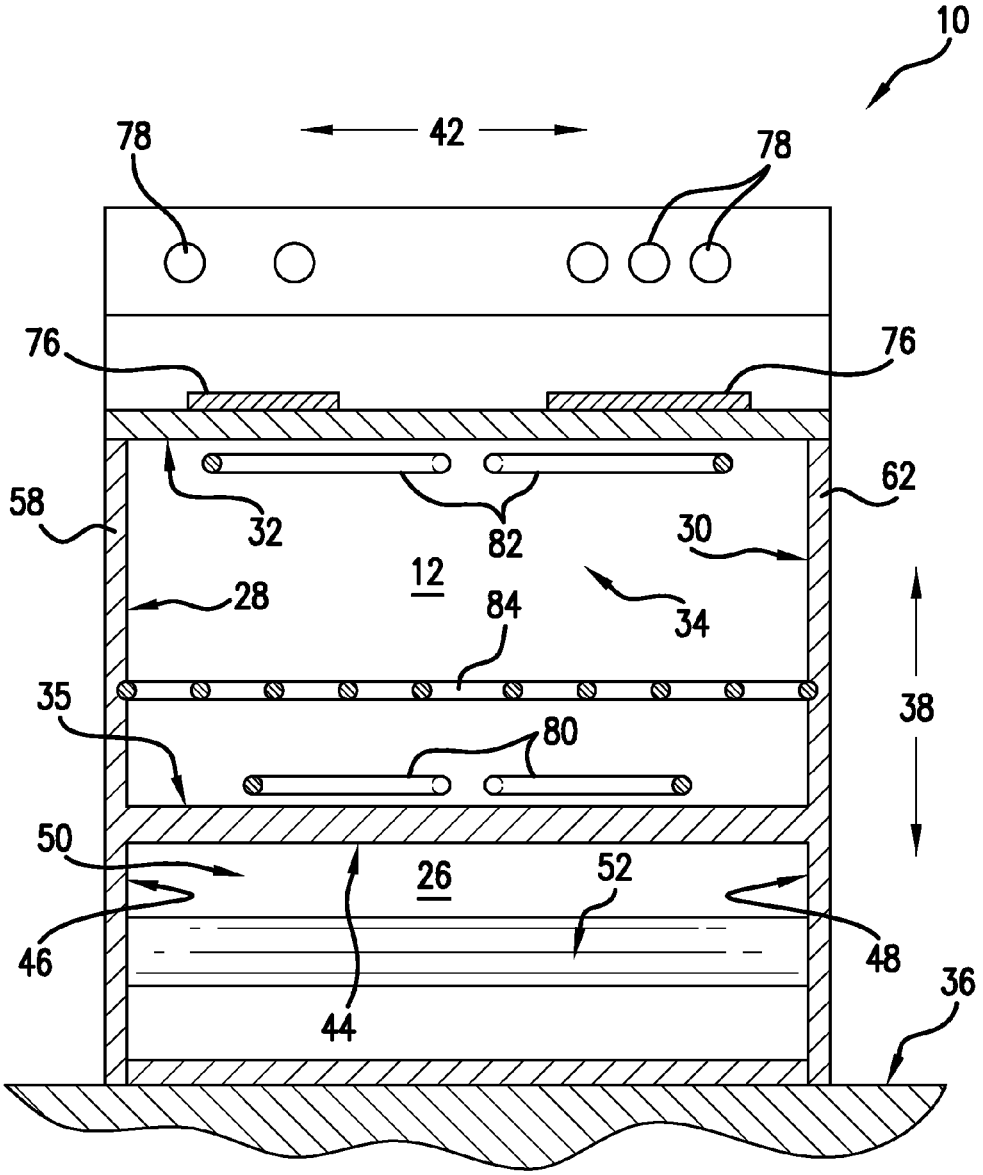
FIG. 7 is a cross-sectional view taken along line 7-7 of FIG. 2.

With reference to FIG. 7, the oven 10 can be arranged so that the cooking area 12 has a generally rectangular cross-sectional shape. The cooking area 12 may be defined by a series of surfaces that are part of different horizontal and vertical walls of the oven 10. A first side panel 58 and a second side panel 62 are located on opposite sides of the oven 10 in the lateral width direction 42. A cooking area first side surface 28 is defined on the first side panel 58, and a cooking area second side surface 30 is defined on the second side panel 62. The cooking area first and second side surfaces 28 and 30 may be flat in the vertical direction 38 and can function to partially define the cooking area 12. A cooking area back surface 34 may be contiguous with the cooking area first and second side surfaces 28 and 30 and may also function to partially define the cooking area 12. The cooking area back surface 34 may be a flat surface in the vertical direction 38. An upper horizontal wall of the oven 10 that may carry the burners 76 may have a cooking area top surface 32 on its lower end. The cooking area top surface 32 may be a flat surface in the lateral width direction 42 and can at least partially define the cooking area 12. An intermediate or bottom wall of the oven 10 may have a cooking area bottom surface 35 defined on its upper end that may be a flat surface upon extension in the lateral width direction 42. The cooking area bottom surface 35 may also function to at least partially define the cooking area 12.

The cooking area 12 may thus be defined by the surfaces 28, 30, 32, 34 and 35. The front end of the cooking area 12 may be defined by the inner surface 18 of the oven door 14 when the oven door 14 is in the closed position 20. When the oven door 14 is opened, the front end of the cooking area 12 is open thus allowing access into and out of the cooking area 12. The oven 10 can be any type of oven and may include any number of heating elements or types of heating mechanisms to heat the cooking area 12. As shown, a heating element 80 is located proximate to the cooking area bottom surface 35. Another heating element 82 is located at the upper end of the cooking area 12 proximate to the cooking area top surface 32. Heating element 82 may be used for broiling food in the cooking area 12 in some embodiments. A rack 84 can engage the cooking area first and second side surfaces 28 and 30 and food can be placed thereon when using the oven 10. It is to be understood that the disclosed elements of the oven 10 are only exemplary and that they may not be present in other embodiments, and additional features can be included in yet additional exemplary embodiments.

FIG. 7 also shows various components of the receiving compartment 26. The receiving compartment 26 can be at least partially defined by a number of horizontal and vertical walls of the oven 10. The first side panel 58 may include a receiving compartment first side surface 46 and a second side panel 62 may include a receiving compartment second side surface 48. The side surfaces 46 and 48 may each be flat vertical surfaces in the vertical direction 38 and may at least partially define the receiving compartment 26. A back vertical surface of the oven 10 may include a receiving compartment back surface 50 that is a flat vertical surface that extends in the vertical direction 38. The receiving compartment back surface 50 may be contiguous with the receiving compartment first and second side surfaces 46 and 48 along with a receiving compartment top surface 44. The receiving compartment top surface 44 may be a flat horizontal surface that is located at the lower end of an intermediate horizontal wall of the oven 10. The receiving compartment top surface 44 may define the upper end of the receiving compartment 26 and as previously discussed may or may not extend all the way to the oven door 14 so that a gap may or may not be present. This gap, if present, would create an opening between the cooking area 12 and the receiving compartment 26 so that these two areas are not completely separate from one another. An intermediate wall of the oven 10 can have the receiving compartment top surface 44 on its lower end and the cooking area bottom surface 35 on its upper end.

The receiving compartment bottom surface 52 as previously discussed may have a concave shape. Although the receiving compartment bottom surface 52 is shown as being defined on the top of a solid block of material, it is to be understood that this is for sake of example only and that the solid block of material may in fact be hollow in other arrangements. The receiving compartment 26 may be defined by the surfaces 44, 46, 48, 50 and 52. Due to the concave shape of the receiving compartment bottom surface 52, a separate front surface is not noted since the receiving compartment bottom surface 52 curls up to in effect form the front defining surface of the receiving compartment 26. In other embodiments, a distinct front surface can be present to define the front of the receiving compartment 26. One or more of the various surfaces 44, 46, 48, 50 and 52 may be insulated to prevent heat from being readily transferred out of the receiving compartment 26 due to the presence of a hot oven door 14 when disposed therein. An appropriate heat removal scheme, such as a vent or radiator may be incorporated to disperse heat from the receiving compartment 26 if desired. In other arrangements, no heat removal mechanism may be put in place for removal of heat from the receiving compartment 26.

Figure 8:
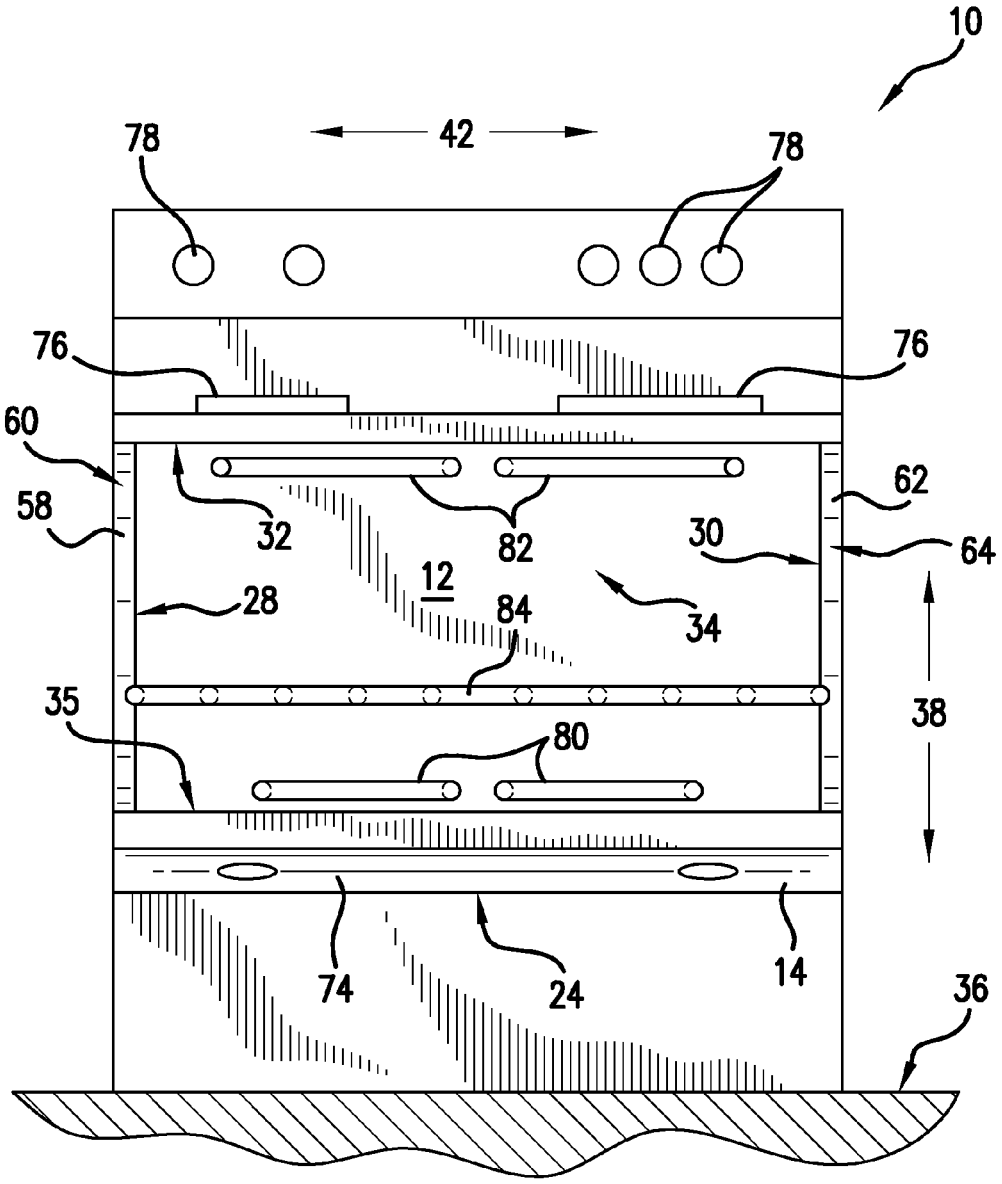
FIG. 8 is a front view of an oven with the oven door in an open position in accordance with another exemplary embodiment.

A front view of the oven 10 with the oven door 14 in the open position 24 is illustrated with reference to FIG. 8.

Range ovens 10 typically have a storage compartment located below the cooking area 12 of the oven in the vertical direction 38 for the storage of items such as pots and pans. The oven 10 of FIG. 8 does not include such a storage compartment, but rather in its place the receiving compartment 26 is located. In other exemplary embodiments, a storage compartment may be located below the receiving compartment 26 in the vertical direction 38. As shown, the first and second side panels 58 and 62 are arranged so that the width of the oven door 14 is sized so as to be flush with the exterior lateral ends of the first and second side panels 58 and 62 in the lateral width direction 42. The handle 74 in this exemplary embodiment has a pair of apertures for use in being grasped by the user to pull the oven door 14 up and down as desired.

Figure 9:
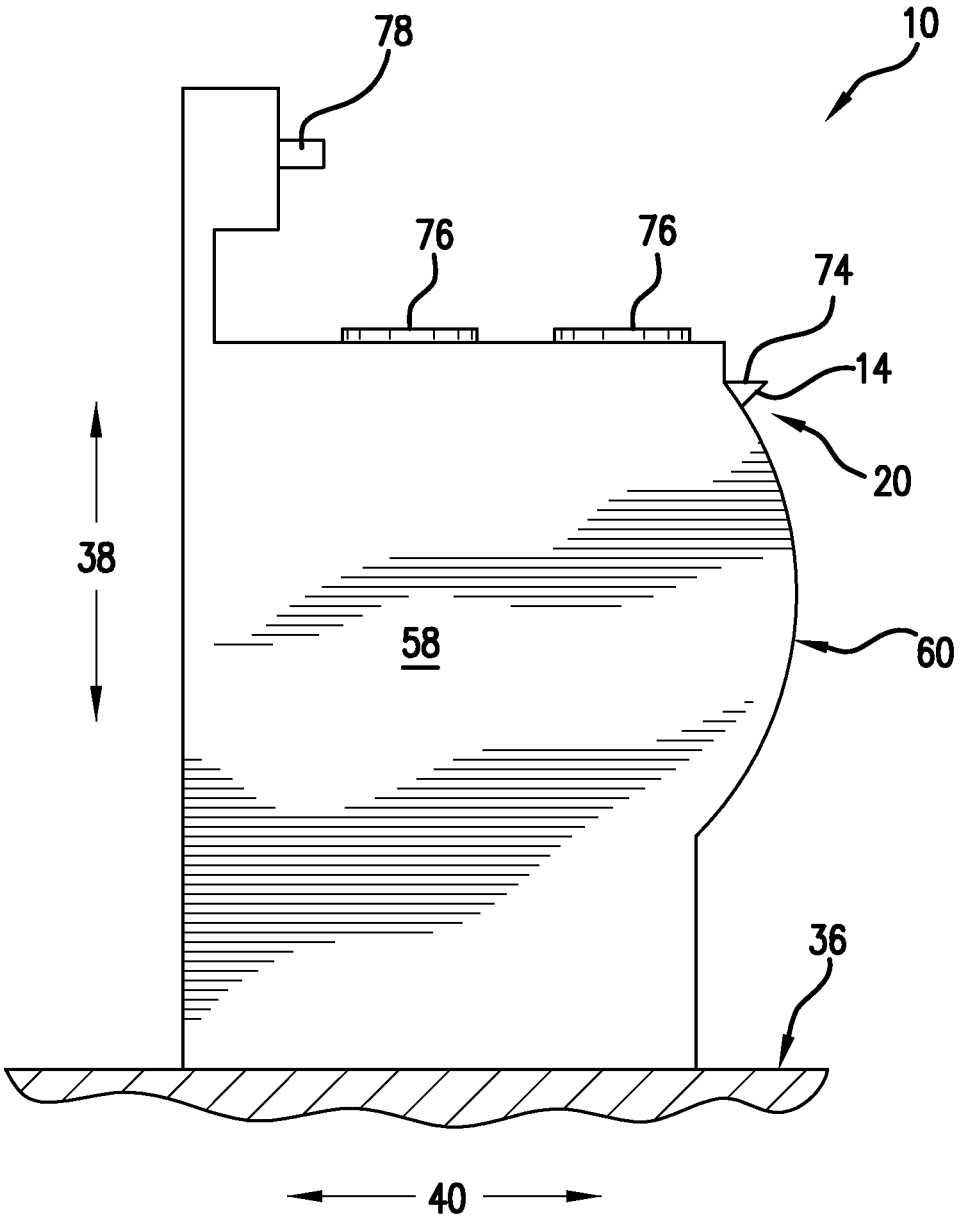
FIG. 9 is a side view of an oven in accordance with another exemplary embodiment.

Another exemplary embodiment of the oven 10 is illustrated with reference to FIG. 9. The first side panel 58 is shown and functions to close off a side of the cooking area 12 and the receiving compartment 26. The oven door 14 is not visible due to the presence of the first side panel 58 except for the handle 74 that extends beyond the proximate portion of the first side panel 58 in the longitudinal depth direction 40. The first side panel 58 has a front surface 60 that is located at the terminal end of the first side panel 58 forward in the longitudinal depth direction 40. The front surface 60 has a curved portion that is convex in shape. The entire front surface 60 can have a convex shape in other exemplary embodiments. The convex shape of the front surface 60 may correspond with the convex shape of the outer surface 16. The bottom portion of the front surface 60 is vertically linear in shape as it may correspond to the bottom of the oven 10 proximate the receiving compartment 26. In other arrangements, the front surface 60 need not have a convex shaped portion. Although not explicitly disclosed in FIG. 9, an oppositely disposed second side panel 62 and its front surface 64 can be arranged in manners similar to those previously described with respect to the first side panel 58 and the front surface 60 and a repeat of this information is not necessary.

Figure 10:
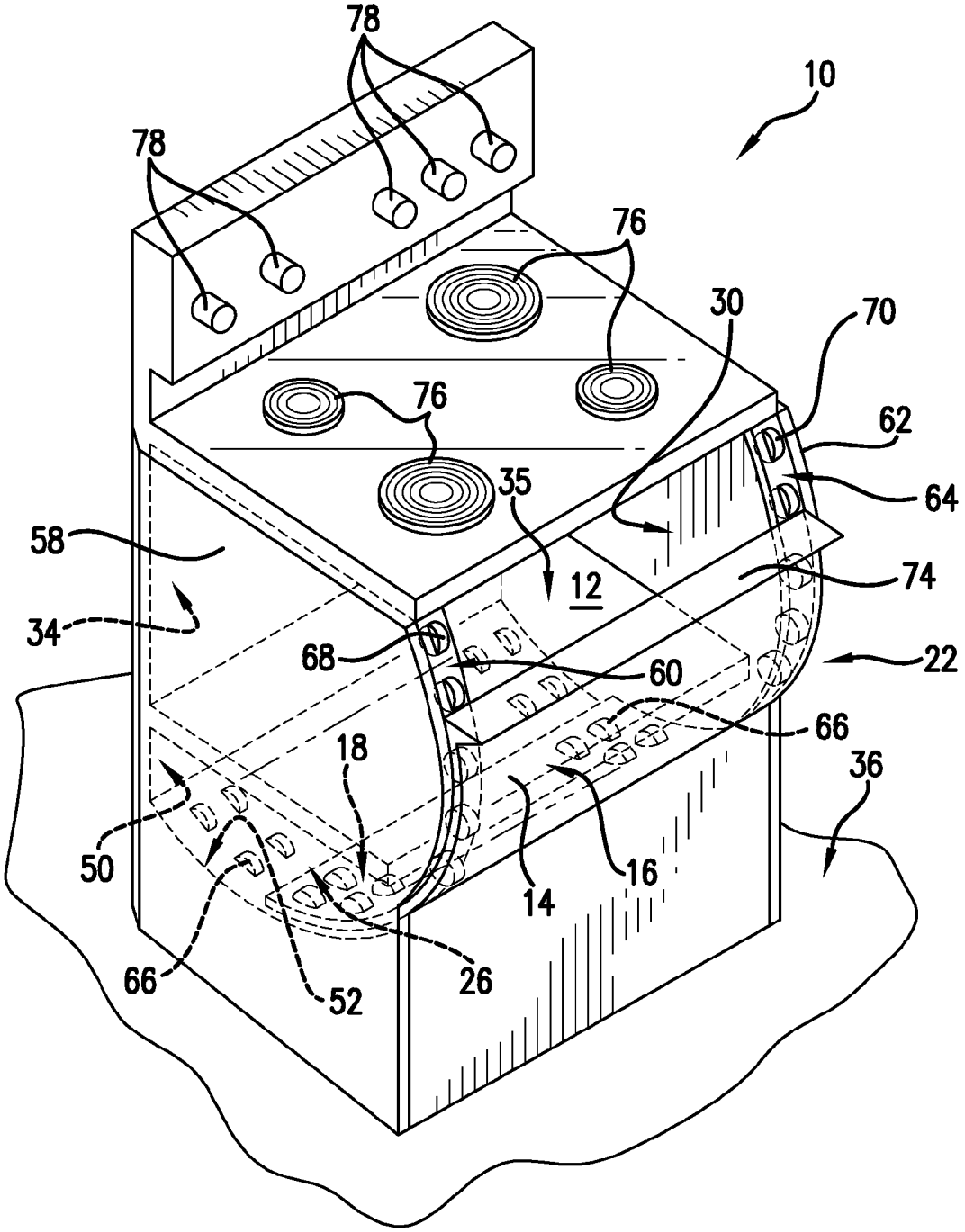
FIG. 10 is a perspective view of an oven in accordance with another exemplary embodiment.

FIG. 10 is a perspective view of an oven 10 in accordance with another exemplary embodiment. The oven door 14 is shown in the intermediate position 22. As discussed, any type of arrangement may be provided in order to allow the oven door 14 to move relative to the other parts of the oven 10 such as the cooking area 12. These arrangements may allow the oven door 14 to move relatively easily between its various positions with any desired amount of force needed to effect movement. In the embodiment illustrated, the front surface 60 of the first side panel 58 is provided with a series of first side panel rollers 68. Likewise, the front surface 64 of the second side panel 62 includes a number of second side panel rollers 70. The inner surface 18 may engage the side panel rollers 68, 70 and can more easily be moved along the travel path 54. The side panel rollers 68 and 70 may be arranged so that they can rotate completely 360° about their axes of revolution that can be disposed and extend in the lateral width direction 42.

The receiving compartment 26 may also be provided with a series of receiving compartment rollers 66. The receiving compartment rollers 66 can be located at the receiving compartment bottom surface 52 and may rotate completely 360° about their axes that are oriented in the lateral width direction 42. The outer surface 16 of the oven door 14 can engage the receiving compartment rollers 66 when the oven door 14 is moved into and out of the open position 24 and the intermediate position 22. In this regard, the oven door 14 may not even engage the receiving compartment bottom surface 52 but instead may only engage the receiving compartment rollers 66. The receiving compartment bottom surface 52 need not be concave or curved in other exemplary embodiments. The various rollers 66, 68 and 70 may be made so that they can rotate with any degree of frictional resistance thus making it easier or harder to move the oven door 14 between its various positions.

Figure 11:
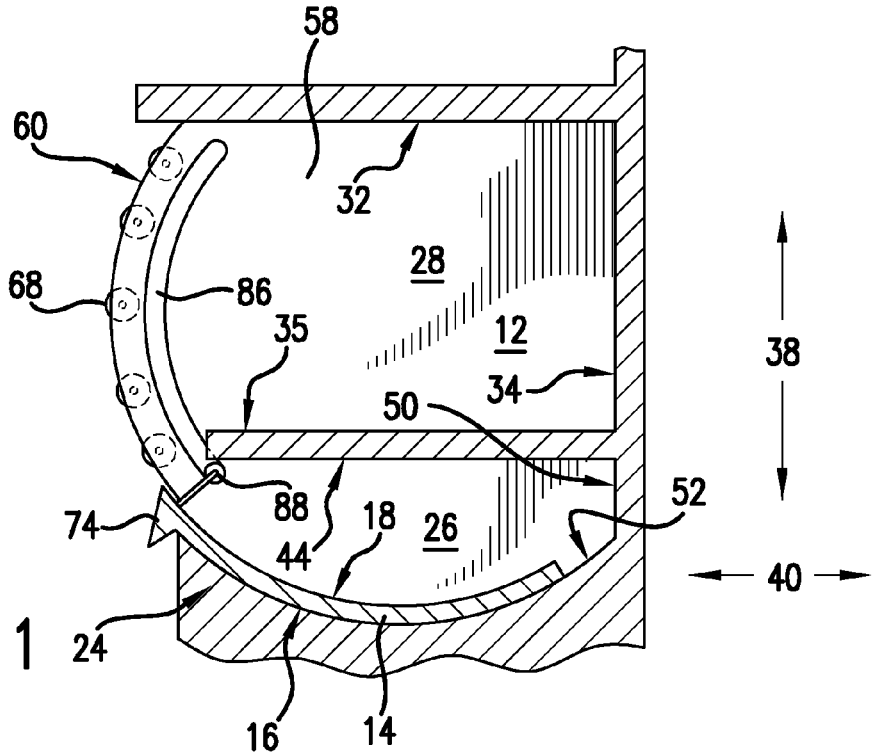
FIG. 11 is a side view of a portion of the oven of FIG. 10 with the oven door in the open position.

With reference now to FIG. 11, the cooking area first side surface 28 is shown in relation to the oven door 14 that is in the open position 24. The first side panel 58 has a front surface 60 that is convex in shape. The first side panel rollers 68 extend outward beyond the front surface 60 in the longitudinal depth direction 40 such that a portion of the first side panel rollers 68 are within and a portion are beyond the first side panel 58 in the longitudinal depth direction 40. As the inner surface 18 may engage only the first side panel rollers 68, the inner surface 18 need not even engage the front surface 60.

An engagement member 88 may extend from the oven door 14 and may be at least partially disposed within a slot 86. The slot 86 can be curved in shape to correspond to the curvature of the front surface 60 and/or the convex outer surface 16. The slot 86 may be defined within the first side panel 58 and may be located in the cooking area first side surface 28. As the oven door 14 moves between positions, the engagement member 88 may move within the slot 86 from top to bottom and back up again. The engagement member 88 can be variously configured and may include a roller in some arrangements. The engagement member 88 may function as a stop as shown in FIG. 11 in that continued downward movement of the engagement member 88 along the slot 86 eventually causes the engagement member 88 to be located in the terminal bottom position of the slot 86. At this point, the engagement member 88 can contact the cooling area first side surface 28 and will be prevented from moving further downward thus stopping further movement of the oven door 14.

Figure 12:
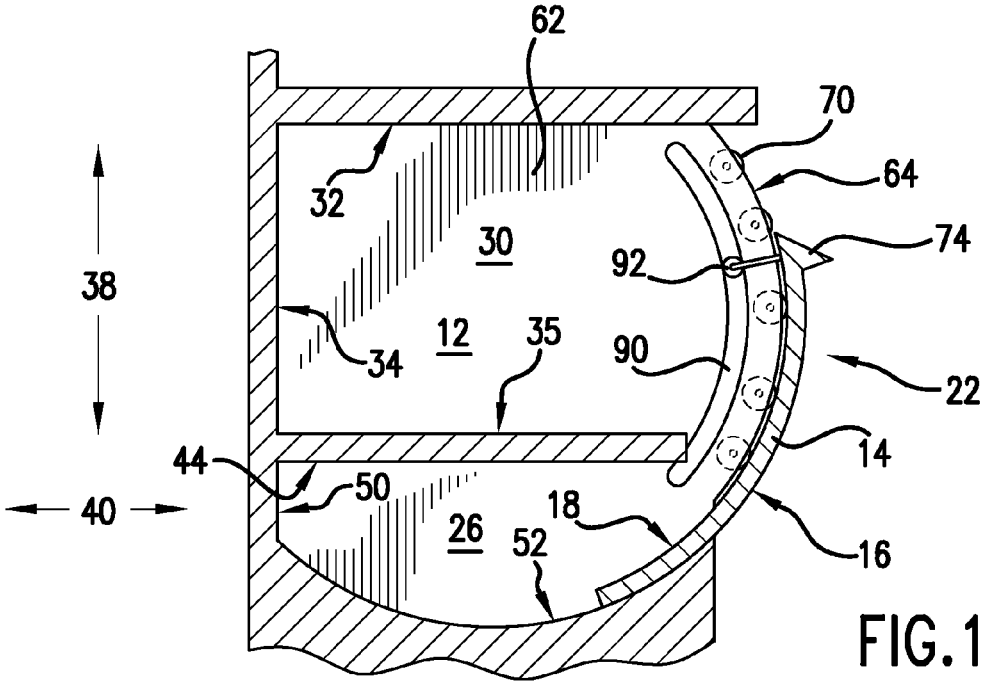
FIG. 12 is a side view of a portion of the oven of FIG. 10 with the oven door in an intermediate position.

FIG. 12 shows the cooking area second side surface 30 as it is defined on an interior portion of the second side panel 62. The front surface 64 is convex in shape and may correspond to the shape of the convex outer surface 16. As with the convex portion of the front surface 60, the axis of revolution of the convex portions of the front surfaces 60 and 64 may extend in the lateral width direction 42 and may be coaxial with the axis of revolution 56 in accordance with certain exemplary embodiments. A slot 90 may be located in the cooking area second side surface 30. As with slot 86, slot 90 may be a through aperture or need not extend completely through the member into with it is defined. Also as with slot 86, slot 90 can be curved so that it has an axis of revolution coaxial with the axis of revolution 56. The curvature of slot 90 may be made to correspond to the curvature of the outer surface 16 or to the front surface 64. An engagement member 92 may extend from the oven door 14 and can be received within the slot 90. The engagement member 92 may include a roller portion in some arrangements. Movement of the oven door 14 between its different positions causes the engagement member 92 to move along the slot 90. The oven door 14 is shown in an intermediate position 22 in FIG. 12. However, should the oven door 14 continue to move further downward into the open position 24, the engagement member 92 may function as a stop once moved to the bottom of slot 90. Here, the engagement member 92 will contact the cooking area second side surface 30 once it moves to its bottom position in slot 90 and prevent the oven door 14 from further movement.

The second side panel rollers 70 may be partially within and partially outside of the front surface 64. The inner surface 18 may engage the second side panel rollers 70 so that the inner surface 18 does not actually engage the front surface 64 but only touches the second side panel rollers 70. The upper ends of the slots 86 and 90 may also function as stops for the oven door 14 into the closed position 20. In this regard, upward movement of the oven door 14 will eventually cause the engagement members 88 and 92 to be located at their upper positions in the slots 86 and 90 at which time they will engage the material of the first and second side panels 58 and 62 to be prevented from further upward movement.

The engagement members 88 and 92 along with their corresponding slots 86 and 90 provide an arrangement that can not only stop the oven door 14 in various locations, but may also assist in constraining the movement of the oven door 14 about its travel path 54. It is to be understood that these features need not be present in other arrangements of the oven 10.

Figure 13:
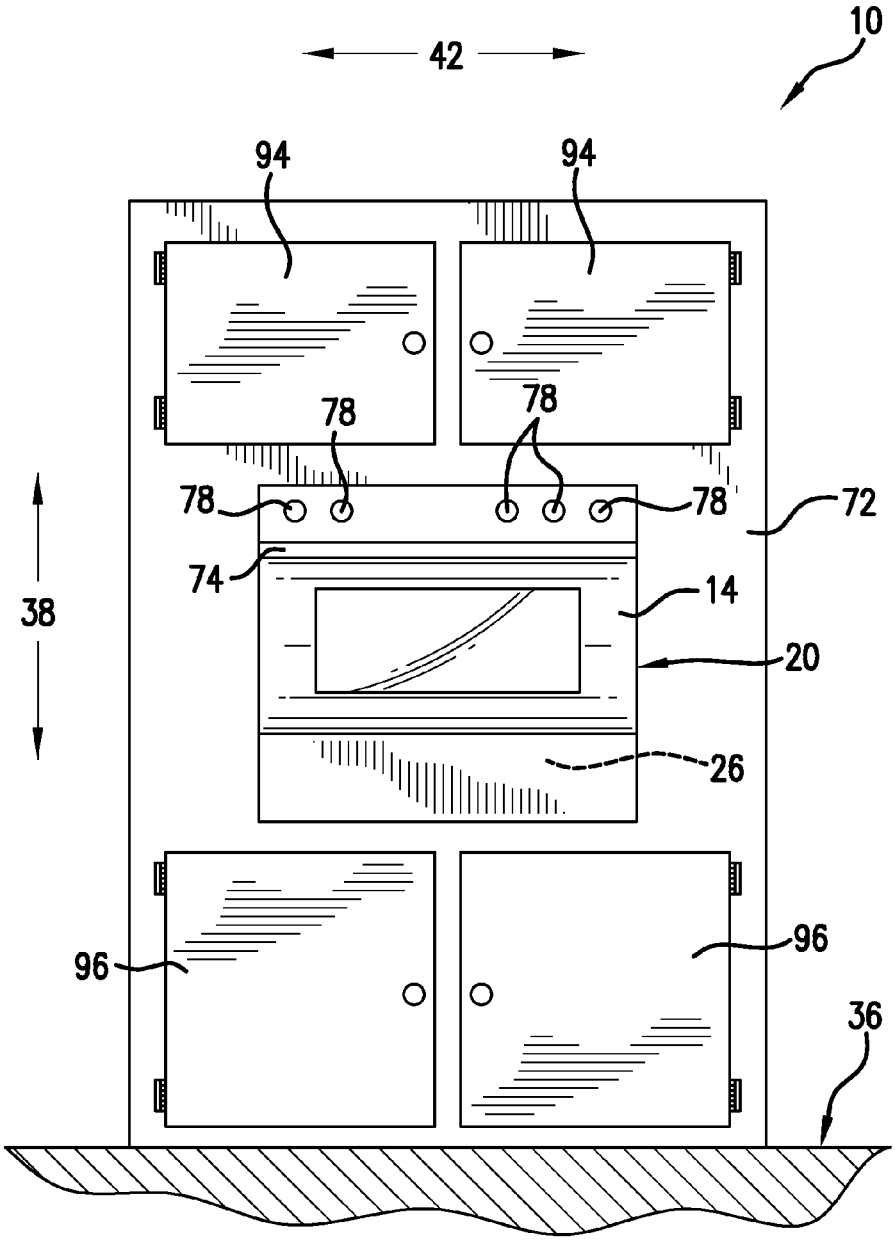
FIG. 13 is a front view of an oven configured as a wall oven in accordance with one exemplary embodiment.

The oven 10 when arranged as a range is located on and contacts the floor 36 of the kitchen, deck or other area at which it is located. The oven 10 could be a smaller toaster oven that is located on a countertop or table in other exemplary embodiments so that the oven 10 does not actually contact the floor 36. In yet other embodiments, such as that shown in FIG. 13, the oven 10 may be a wall oven in which it is disposed within a vertical wall 72 of a kitchen or other building or area. The wall oven 10 need not have burners 76 which instead can be located on a countertop to the side of the wall oven 10. The wall oven 10 may include an oven door 14 that can be configured in the manner previously described. A set of cabinets 94 can be located in the vertical wall 72 above the wall oven 10 in the vertical direction 38 for the storage of various items such as containers, pots, and pans. A similar set of cabinets 96 can be located below the wall oven 10 in the vertical direction 38 so as to be between the floor 36 and the wall oven 10 in the vertical direction 38. As such, the oven 10 when configured as a wall oven 10 need not engage the floor 36. It is to be understood that the various configurations of the oven 10 are only exemplary and that others are possible.

The oven door 14 may be made of a single component such that when it moves from the closed position 20 to the open position 24 no portion of the oven door 14 moves relative to another portion of the oven door 14. However, in other arrangements, the oven door 14 may in fact be made of multiple sections that do move or shift orientations relative to one another upon movement from the closed position 20 to the open position 24. The travel path 54 may not have a sliding/linear component in some embodiments but may be completely curved in shape. The variously described surfaces need not be planar but can have various protrusions and cavities thereon and therein. As previously mentioned, various configurations can be made to cause the oven door 14 to be movable from the closed position 20 to the open position 24 and then back again. Curve shaped tracks can be provided onto which the oven door 14 can ride to cause the oven door 14 to move between the positions 20 and 24.

The side edges of the oven door 14 may be visible from the side of the oven 10, or the two side panels 58 and 62 may be located on the outward sides of the oven door 14 in the lateral width direction 42 to hide the side edges of the oven door 14 in accordance with various exemplary embodiments. In some embodiments, the oven 10 provides an extra 30 inches of kitchen space when the oven door 14 is open.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed:

1. An oven, comprising:

a cooking area of the oven defined by at least one internal surface including a cooking area bottom surface;

an oven door that has an outer convex surface, wherein the oven door is movable from a closed position in which the oven door blocks access to the cooking area from outside of the oven to an open position in which the oven door does not block access to the cooking area from outside of the oven, wherein the oven door has an end that closes the cooking area at a wall of the oven when the oven door is in the closed position, wherein the end engages the wall when the oven door is in the closed position, wherein the end extends from the outer convex surface to an inner concave surface of the oven door and wherein the inner concave surface of the oven door is free from engagement with the wall when the oven door is in the closed position, wherein the end moves away from the wall when the oven door is moved out of the closed position such that the end is exposed and free from engagement with the wall before being moved to the open position, wherein the wall is above the cooking area and the oven door moves downward relative to the wall when moving from the closed position to the open position;

a door receiving compartment that receives at least a portion of the oven door when the oven door is in the open position, said door receiving compartment having a bottom concave surface complimentary to said outer convex surface of said oven door and a top surface perpendicular to a back wall of said oven, wherein said door receiving compartment is enclosed in said oven, wherein when the oven door is in the open position such that the oven door cannot move any farther from the closed position the end of the oven door is not located within the receiving compartment and is free from engagement with the wall; and an intermediate wall separating the cooking area of the oven and the door receiving compartment, and is at least partially defined by the cooking area bottom surface of the cooking area and the top surface of the door receiving compartment, and is free from engagement with the oven door in the closed and open positions.

2. The oven as set forth in claim 1, wherein the internal surface is a cooking area first side surface, and further comprising:

a cooking area second side surface;

a cooking area bottom surface;

a cooking area top surface, wherein the cooking area top surface is defined on the wall of the oven and the end of the oven door engages the cooking area top surface when the oven door is in the closed position; and a cooking area back surface, wherein the cooking area first side surface, the cooking area second side surface, the cooking area bottom surface, the cooking area top surface, and the cooking area back surface are all internal surfaces and face and at least partially define the cooking area of the oven.

3. The oven as set forth in claim 1, wherein the door receiving compartment is located outside of and below the cooking area of the oven such that the door receiving compartment is located between the cooking area of the oven and the floor.

4. The oven as set forth in claim 3, wherein said door receiving compartment further comprises:

a first side surface;

a second side surface; and a back surface;

wherein the door receiving compartment top, first side, second side, back, and bottom surfaces are all internal surfaces and face and at least partially define the door receiving compartment.

5. The oven as set forth in claim 1, wherein the convex surface of the oven door is an outer surface of the oven door, and wherein an inner surface of the oven door is concave in shape; and further comprising a handle that is located at the end of the oven door.

6. The oven as set forth in claim 1, wherein a travel path of the oven door is curved along its entire length from the closed position of the oven door to the open position of the oven door.

7. The oven as set forth in claim 1, further comprising:

a first side panel that has a front surface with a portion of the first side panel that is convex in shape; and a second side panel that has a front surface with a portion of the second side panel that is convex in shape.

8. The oven as set forth in claim 7, further comprising:

a plurality of door receiving compartment rollers located at said door receiving compartment bottom surface that engage the oven door when the oven door is in the open position;

a plurality of first side panel rollers located at the first side panel that engage the oven door when the oven door is in the closed position; and a plurality of second side panel rollers located at the second side panel that engage the oven door when the oven door is in the closed position;

wherein the oven door moves along a curved travel path from the closed position to the open position that has a single axis of revolution such that the oven door is constrained to move around the single axis of revolution only, wherein the travel path has an arc length that is less than 270°.

9. An oven, comprising:

an oven door that has an outer surface that is convex in shape, wherein the oven door is movable from a closed position to an open position, wherein the travel path of the oven door from the closed position to the open position is curved the entire way from the closed position to the open position, wherein the travel path has an axis of revolution; and a cooking area back surface, wherein the axis of revolution is located between the cooking area back surface and the oven door when the oven door is in the closed position, wherein a longitudinal direction of the oven is perpendicular to the axis of revolution and extends from the cooking area back surface to the oven door when the oven door is in the closed position, wherein the outer surface of the oven door in the closed position extends away from and then towards the cooking area back surface in the longitudinal direction along the travel path;

wherein the oven door has a handle, wherein the oven door has an intermediate position located between the closed position and the open position on the travel path, wherein the handle is located farther from the cooking area back surface in the longitudinal direction when the oven door is in the intermediate position than when the oven door is in the closed or the open positions;

wherein the oven door is a single oven door that covers an entire front opening of the cooking area to seal the interior of the oven when the oven door is in the closed position, wherein the oven door rotates in only one direction about the axis of revolution when rotating from the closed position to the open position;

a cooking area top surface and a cooking area bottom surface that along with the cooking area back surface partially define a cooking area, wherein the oven door engages the cooking area top surface when the oven door is in the closed position, wherein the oven door moves downward relative to the cooking area top surface when moving from the closed position to the open position, and wherein the oven door is free of engagement with the cooking area bottom surface in the closed and open positions;

a door receiving compartment that receives at least a portion of the oven door when the oven door is in the open position having a bottom concave surface curved in the longitudinal direction and a top surface perpendicular to a back wall of said oven and free of engagement with the door in the closed and open positions, wherein said door receiving compartment is enclosed in said oven.

10. The oven as set forth in claim 9, wherein the axis of revolution is a single axis of revolution that is located in the cooking area, and wherein the oven door is constrained to move around the single axis of revolution only, wherein the travel path has an arc length that is less than 270°.

11. The oven as set forth in claim 9, wherein the door receiving compartment is located outside of and below the cooking area of the oven such that the door receiving compartment is located between the cooking area of the oven and the floor in the vertical direction and the travel path of the oven door has an axis of rotation located within the door receiving compartment.

12. The oven as set forth in claim 11, wherein said door receiving compartment further comprises:

a first side surface;

a second side surface;

a back surface; and wherein said bottom surface has a concave shape that falls down then rises up in the vertical direction along the travel path in the longitudinal direction, wherein the door receiving compartment top, first side, second side, back, and bottom surfaces are all internal surfaces and face and at least partially define the door receiving compartment.

13. The oven as set forth in claim 9, further comprising:

a first side panel that has a front surface that is at least partially convex in shape; and a second side panel that has a front surface that is at least partially convex in shape.

14. The oven as set forth in claim 13, further comprising:

a plurality of first side panel rollers located at the first side panel that engage the oven door when the oven door is in the closed position; and a plurality of second side panel rollers located at the second side panel that engage the oven door when the oven door is in the closed position.

15. An oven, comprising:

an oven door that has an open position and a closed position, wherein the oven door has an end that engages a wall of the oven and closes a cooking area of the oven at the wall of the oven when the oven door is in the closed position, wherein the end moves away from the wall when the oven door is moved out of the closed position such that the end is exposed and free from engagement with the wall before being moved to an open position of the oven door, wherein the end extends from an outer convex surface of the oven door to an inner concave surface of the oven door, and wherein the inner concave surface of the oven door is free from engagement with the wall when the oven door is in the closed position, wherein the wall is above the cooking area and the oven door moves downward relative to the wall when moving from the closed position to the open position;

the cooking area of the oven defined by at least one internal surface including a cooking area bottom surface that is free of engagement with the oven door in the closed and open positions;

a first side panel that has a front surface that is at least partially convex in shape;

a second side panel that has a front surface that is at least partially convex in shape;

wherein the oven is either a range oven or is mounted into a vertical wall of a building; and a door receiving compartment that receives at least a portion of the oven door when the oven door is in the open position having a bottom concave surface complimentary to said outer convex surface of said oven door and a top surface perpendicular to a back wall of said oven and free of engagement with the door in the closed and open positions, wherein said door receiving compartment is enclosed in said oven, wherein when the oven door is in the open position such that the oven door cannot move any farther from the closed position, the end of the oven door is not located within the door receiving compartment.

16. The oven as set forth in claim 15, further comprising a handle that is located at the end of the oven door, wherein the internal surface is a cooking area top surface that is located on the wall and is engaged by the end of the oven door when the oven door is in the closed position.

17. The oven as set forth in claim 16, wherein the door receiving compartment is located outside of and below the cooking area of the oven such that the door receiving compartment is located between the cooking area of the oven and the floor in the vertical direction.

18. The oven as set forth in claim 16, wherein said door receiving compartment further comprises:

a first side surface;

a second side surface; and a back surface;

wherein the door receiving compartment top, first side, second side, back, and bottom surfaces are all internal surfaces and face and at least partially define the door receiving compartment.

19. The oven as set forth in claim 15, wherein the oven door has a travel path that is curved along its entire length from the closed position to the open position such that the oven door is only capable of being moved along the curved travel path.

20. The oven as set forth in claim 15, wherein the oven door has a travel path that has a single axis of revolution that is located in the cooking area, and wherein the oven door is constrained to move around the single axis of revolution only, wherein the travel path has an arc length that is less than 270°.

* * * * *